US008122856B2

(12) United States Patent
Franke et al.

(10) Patent No.: US 8,122,856 B2
(45) Date of Patent: Feb. 28, 2012

(54) STEAM GENERATOR PIPE, ASSOCIATED PRODUCTION METHOD AND CONTINUOUS STEAM GENERATOR

(75) Inventors: Joachim Franke, Altdorf (DE); Oliver Herbst, Dormitz (DE); Holger Schmidt, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 804 days.

(21) Appl. No.: 12/086,100

(22) PCT Filed: Nov. 22, 2006

(86) PCT No.: PCT/EP2006/068757

§ 371 (c)(1), (2), (4) Date: Jun. 5, 2008

(87) PCT Pub. No.: WO2007/065790

PCT Pub. Date: Jun. 14, 2007

(65) Prior Publication Data

US 2009/0095236 A1 Apr. 16, 2009

(30) Foreign Application Priority Data

Dec. 5, 2005 (EP) ..... 05026487

(51) Int. Cl.
*F28F 1/40* (2006.01)

(52) U.S. Cl. ..... 122/235.17; 122/367.1; 122/511; 165/179; 138/38

(58) Field of Classification Search ..... 122/1 B, 122/44.2, 165, 166.2, 183, 235.17, 367.1, 122/367.3, 406.4, 408.1, 511; 165/134.1, 165/177, 179, 181, 182; 138/37, 38, 39
See application file for complete search history.

(56) References Cited

U.S. PATENT DOCUMENTS 1,668,577 A * 5/1928 Vecchio ..... 165/95
(Continued)

FOREIGN PATENT DOCUMENTS

DE 100563 7/1897
(Continued)

*Primary Examiner* — Gregory A Wilson

(57) ABSTRACT

Disclosed is a steam generator pipe which can be produced in a simple and economical manner and which has a particularly good heat transitional behavior having a large band width with various operational conditions. According to the invention, at least one insert is arranged in the inner chamber of the pipe in order to form a swirl-generating inner profile. The insert comprises a plurality of wires which wind, in a screw-like manner, along the inner wall of the pipe in the form of a multi-path thread.

12 Claims, 3 Drawing Sheets

U.S. PATENT DOCUMENTS

| | | | | | |
|---|---|---|---|---|---|
| 1,859,745 | A | * | 5/1932 | Morley | 122/13.01 |
| 2,731,709 | A | * | 1/1956 | Gaddis et al. | 29/890.049 |
| 3,534,814 | A | * | 10/1970 | Renzi | 165/172 |
| 3,595,299 | A | * | 7/1971 | Weishaupt et al. | 159/28.5 |
| 4,794,983 | A | * | 1/1989 | Yoshida et al. | 165/133 |
| 4,798,241 | A | * | 1/1989 | Jarrett et al. | 165/109.1 |
| 5,497,824 | A | * | 3/1996 | Rouf | 165/184 |
| 6,006,826 | A | * | 12/1999 | Goddard et al. | 165/179 |
| 6,119,769 | A | * | 9/2000 | Yu et al. | 165/109.1 |
| 6,536,380 | B1 | * | 3/2003 | Kral et al. | 122/406.4 |
| 6,997,246 | B2 | * | 2/2006 | Visser | 165/109.1 |
| 2004/0154787 | A1 | | 8/2004 | Hughes et al. | |

FOREIGN PATENT DOCUMENTS

| | | | | |
|---|---|---|---|---|
| EP | 0 302 125 | A1 | | 2/1989 |
| GB | 692306 | | | 6/1953 |
| GB | 1146162 | | | 3/1969 |
| JP | 50153347 | A | | 10/1975 |
| JP | 56142813 | A | * | 11/1981 |
| JP | 6086304 | A | | 5/1985 |
| JP | 61014032 | A | | 1/1986 |
| JP | 02021103 | A | | 1/1990 |
| JP | 05001892 | A | | 1/1993 |
| JP | 11094362 | A1 | | 9/1999 |
| RU | 2214555 | C1 | | 5/2007 |
| SU | 329928 | A | | 2/1972 |
| WO | WO 2005/018837 | A1 | | 3/2005 |

* cited by examiner

STEAM GENERATOR PIPE, ASSOCIATED PRODUCTION METHOD AND CONTINUOUS STEAM GENERATOR

CROSS REFERENCE TO RELATED APPLICATIONS

This application is the US National Stage of International Application No., PCT/EP2006/068757, filed Nov. 22, 2006 and claims the benefit thereof. The International Application claims the benefits of European application No. 05026487.8 filed Dec. 5, 2005, both of the applications are incorporated by reference herein in their entirety.

FIELD OF INVENTION

The invention relates to a steam generator pipe with a swirl-generating internal profile. It further relates to a continuous steam generator with these types of steam generator pipes. The invention further relates to a method for producing a steam generator pipe provided with a swirl-generating inner profile.

BACKGROUND OF THE INVENTION

Steam generator pipes, usually welded to each other in a gas-tight manner via stays for forming a gas draught surrounding the firing chamber are used in the combustion chamber walls of a continuous steam generator, with said pipes being connected in parallel for the throughflow of a flow medium. Instead of pipes with separate flat bar stays lying between them, pipes can also be used which have already been equipped ex-works with fins formed onto them. The steam generator pipes can in such cases be arranged vertically or also inclined. For a safe operating behavior of the continuous steam generator the steam generator pipes are as a rule designed such that, even with low mass flow densities of the medium flowing through the steam generator pipes, a sufficient cooling down of the steam generator pipes is guaranteed.

The heat transfer properties are an important design criterion of a steam generator pipe. A high heat transfer makes an especially effective heating of the medium flowing through the steam generator pipe possible with simultaneous reliable cooling of the steam generator pipe. The heat transfer behavior of a steam generator pipe can be adversely affected in conventional steam generators which are operated at subcritical pressures, by the occurrence of so-called departures from nucleate boiling. In such cases the wall of the pipe is no longer wetted by liquid flow medium—as a rule water—and is thus only inadequately cooled. As a result of drying out too early the strength values of the pipe wall can then be reduced.

To improve their heat transfer behavior steam generator pipes are normally used which, as a result of a molding process (e.g. cold extrusion) have a surface structure or an inner profile on their inner side in the form of spiral wound ribs. The shape of the ribs imparts a swirl to a medium flowing through the steam generator pipe, so that the heavy liquid phase as a result of the action of centrifugal forces collects on the inner wall of the pipe and forms a wetting film of liquid there. This means that even with relative high heat flow densities and low mass flow densities a reliable transfer of heat from the inner wall of the pipe to the flow medium is guaranteed.

A disadvantage of the known steam generator pipes is that they are comparatively expensive to produce as a result of the limited plasticity of the pipe material. With highly heat-resistant steels in particular with a high chrome content the plasticity is greatly restricted. These types of materials have an ever more important role to play nowadays for steam generator pipes, since they—at least in principle—allow a steam generator pipe to be equipped for especially high steam parameters, especially for high fresh steam temperatures, and thus consequently permit high levels of efficiency. The material-related restrictions mean in practice that it is no longer possible, or only possible at great expense, to create internally-ribbed pipes with the desired rib profiles advantageous for flow within the pipe from smooth pipes within the context of a deformation process. In particular sufficiently steep edge angles and sharp-edged transitions in conjunction with large rib heights can only be produced with difficulty or not at all. In addition the height of the ribs can only be produced within a narrow frame. In addition only a small degree of flexibility is afforded in relation to the design of the profile along the pipe.

As alternatives, different types of swirl-generating fitted parts have already been proposed for retrofitting to a steam generator pipe. These especially include what are referred to as "twisted tapes": Tapes produced from a metal strip which are twisted or wound together. However the one aspect common to all the pipe inserts known to date is that on the one hand they block up the (originally) free cross-section in the center of the pipe and thus lead to very high pressure loss, and that on the other hand they impart a pronounced redirection to the entire flow and thereby in some cases "overswirl" it. A simple twisted tape for example leads with higher steam content in the two-phase flow to a collection of the water phase in the gusset between the pipe wall and the tape with simultaneous drying out and thereby inadequate cooling down of the inner wall areas on the lee side of the tape, where the lee side refers to the side of the tape that is the steam averted side in the direction of the steam flow. Steam generator pipes with inserts of the twisted tape type are thus not equally suited to all operating conditions usually occurring with steam generators.

SUMMARY OF INVENTION

The underlying object of the invention is thus to specify a steam generator pipe of the type mentioned at the start that, with production kept simple and cost effective, and for a wide bandwidth of different operating conditions, exhibits an especially favorable heat transition behavior. In addition a suitable method of production of such a steam generator pipe as well as a continuous steam generator is to be specified which, with higher operational safety and a high-level of efficiency, possesses an especially simple construction.

As regards the steam generator pipe the said object is inventively achieved by at least one insert being arranged on the inside of the pipe for forming a swirl-generating inner profile, with the insert comprising a number of wires which are wound along and as a type of multiple thread in a spiral on the inner wall of the pipe.

The invention is based in this case on the idea that the multiple phase flows through a steam generator pipe should exhibit a swirl in order to improve the heat transfer so that the liquid phase is directed as a result of a rotation to the inner wall of the pipe and wets the latter as evenly as possible. For explicitly establishing and maintaining this type of swirling flow suitable flow-directing elements should thus be arranged in the inside of the pipe. As it has turned out the flow direction is especially favorable if on the one hand neither an "overswirling" causes too great pressure losses to occur along the flow path, on the other hand the swirl effect is still intensive enough to direct the liquid phase of the flow medium over the entire circumference on the inner wall of the pipe.

To avoid high pressure losses which lead to a high inherent energy demand for the feed water pump, and to safeguard the output of the steam in the inside of the tube the flow-directing elements should essentially be arranged as a type of inner profile on the inner wall of the pipe and not obstruct the pipe cross section in the center or only obstruct it slightly. In the order over and above this to get around the production limitations associated with conventional designs of ribbed pipes, the swirl-generating inner profile should be implemented by a pipe and fitments or inserts which can be produced independently of the steam generator pipes in the desired form and can be inserted afterwards into the pipe. For this purpose, in the new concept presented here, wires or bands are provided, which after incorporation into the steam generator pipe, are wound along in a spiral shape on the inner wall of the pipe so that a significant part of the pipe cross-section (more than 50%) remains free and the steam can thereby accumulate and flow away in the inside of the pipe.

Furthermore it has been recognized that a simple, i.e. single-start spiral spring only generates a weak swirl as a rule. The flow can shear in this case over the wire present on the inner wall of the pipe. Because of the low level of rotation this then causes a premature onset of the departure from nucleate boiling. Although this effect could be compensated for by a larger wire diameter (similar to a larger rib height) for example, however with a wire arrangement in the shape of a simple spiral spring, this easily leads to an accumulation or congestion of the water phase in the gusset between at the pipe wall and the wire insert with simultaneous drying out of the inner wall areas on the lee side of the wire, i.e. to and inadequate cooling of the corresponding wall areas. These types of disadvantage are avoided according to the concept presented here by a plurality of wires in the form of a multi-start thread resting on the inner wall of the pipe in each case. In this version, even with moderate swirl strengths and comparatively low pressure losses and an even wetting of the inner wall of the pipe with liquid flow medium is achieved; an overswirling of the flow is completely avoided on the other hand.

Also of particular advantage is that, by contrast with ribbed pipes of conventional construction which are produced using a shaping process employing significant shaping forces from smooth pipes, there is great flexibility in respect of the inflow-relevant parameters, such as profile height, number of starts, angle of inclination, edge angle and sharpness of edges. Corresponding design requirements can be implemented especially easily and precisely in the embodiment as an insert part, since as a rule only wires or metal tapes with the appropriate cross-sectional profile are provided as a rule here and have to be placed in the desired arrangement, e.g. by twisting and/or bending.

With steam generator pipes with normal dimensions and measurements an arrangement of the wires in the form of a two or three-start thread is particularly useful. However four to six-start versions can be advantageous; with steam generator pipes with an especially large diameter even eight-start variants are conceivable. Advantageously the angle of inclination of the respective wire amounts to at least 30° and preferably at most 70° in relation to a reference plane perpendicular to the axis of the pipe. Especially advantageous is an angle of inclination of between 40° and 55°.

To enable it to be produced especially simply and cost effectively, the respective wire has a round or an essentially rectangular cross section. With the latter embodiment the edges can especially be processed so that comparatively steep edge angles and a sharp edged transitions can be realized. The wires can vary in their diameter depending on the diameter of the steam generator pipe and depending on the intended flow and temperature conditions. In general a wire diameter or an average cross-sectional extent of 5% to 15% of the internal diameter of the smooth pipe is advantageous.

Advantageously the respective wire or the tube insert formed from the wires is seated for the intended operating temperature of the steam generator pipe as a result of its inherent tension in a non-slip manner within the pipe. The wire material and the internal tension are thus matched to the geometrical conditions such that a creeping or a movement of the individual windings in relation to each other is suppressed.

If it proves necessary the wires positioned on the inner wall of the pipe can be connected via radial stiffening webs to each other and/or to a center wire running along the axis of the pipe. This type of support core prevents a slippage of the individual spring starts even with a possible loosening of the wire or spring tension so that the wire insert permanently retains its original form and position in the steam generator pipe. In addition or as an alternative a number of retaining wires running in the direction of the pipe axis can be provided which are fixed in each case on the side of the wires wound into the shape of a spiral to said wires on the side facing the inside of the pipe. In this way a similar effect is produced as with the embodiment with the radial stiffening stays. The support core comprising the stiffening stays and/or the retaining wires and/or the center wire can be produced from a material which is of lower value than the swirl-generating wires lying on the inner wall of the pipe since it only has to be protected against corrosion or oxidation wear, and is not directly subjected to the very high temperatures of the inner wall of the pipe.

Although the pipe insert is already seated relatively firmly and securely in the steam generator pipe as a result of the internal tension of its wires, an additional fixing is preferably provided in which the wire forming the respective profile is connected at least one point, preferably in the vicinity of its two ends, firmly to the inner wall of the pipe. The firm connection is advantageously made in such cases by a highly heat-resistant welded connection. A variant which is slightly more expensive to produce but which however guarantees an especially secure fixing, comprises a plurality of the spot welds distributed along the longitudinal extent of the respective pipe. The welded fixing can be produced especially well if at least the wires of the insert lying against the inner wall of the pipe are produced from a material with a composition similar to the pipe material.

Furthermore it is desirable precisely with a comparatively long steam generator pipe extending over the entire height of the steam vessel to provide different guide profiles in the inside the pipe along its longitudinal extension depending on location, which take account of the spatial development or variation both of the steam component and also of the heating profile. Such a concept can be advantageously realized by a plurality of inserts being inserted into the steam generator pipe which are arranged in separate pipe sections in each case, with the respective inserts being adapted with its geometrical parameters to the local heating provided for during operation and/or the local flow conditions. Since it has also proved that, once the swirl is generated, even with a two-phase flow it is retained at least over a flow distance of five pipe diameters, a complete seamless equipping of the pipe is not necessary. Instead the inserts can be built into the steam generator pipes separated from each other by spaces.

Expediently the steam generator pipes are used with a fossil-fuel heated continuous steam generator. The swirl generating internal profile of the pipes and the associated improvements in heat transfer behavior mean that even with vessel constructions with vertical pipe arrangements (perpendicular piping) a sufficient heat transfer to the flow medium or a cooling of the pipe walls is guaranteed. A perpendicular piping it with a large number of pipes and with comparatively short pipe lengths, because of the lower flow speeds and lower mass flow compared to angled or spiral form piping makes operation of the steam generator with reduced pressure loss and with a reduced minimum throughflow possible. This enables the power-station including at the steam generator to be designed for a lower minimum load. The separation effects known from inclined steam generator pipes in which water and steam, if a minimum flow speed or a minimum load is undershot, only still flow in layers so that part areas of the pipe walls can no longer be wetted, do not occur with perpendicular piping. In addition expensive support constructions for the steam vessel associated with complex and cost-intensive welding are not necessary since a vessel wall with perpendicular piping can as a rule be designed to be self-supporting.

Furthermore the said pipe fitments, even with convective heating, such as occurs in the heating vessel of combined-cycle power stations, can as a result of the improved heat transfer lead to a reduction of the heat exchanger surface and thus to significant cost savings.

In relation to the production method the above object is achieved by a plurality of wires under tension being inserted into a smooth pipe with the wires being arranged as a type of multiple thread, with the tension in the wires being relaxed after insertion until their windings are positioned against the inside of the pipe. In other words: The multi-start spiral springs formed by the wires aligned in advance are pre-tensioned by for example being pulled apart or twisted together. In this state with reduced diameter the insert is drawn into the pipe. After its partial release it presses automatically onto the inner wall of the pipe. The remaining inherent tension of the wires is selected in this case so that no creepage can occur at the intended operating temperature of the steam generator pipe. In addition the wires are advantageously welded at least one end to the inner wall of the pipe after their partial release.

The advantages obtained with the invention lie especially in the fact that with the new pipe inserts a flexible flow guidance able to be employed for all pipe materials is produced inside the pipe which can be adapted to meet the demand for improving heat transition. As a result of the design flexibility brought about by freely-designable parameters wire diameter, number of starts of the wire arrangement, angle of inclination, edge angle and edge sharpness, a swirl profile which varies over the length of the steam generator pipe can be set which is adapted precisely to the respective local heating. Such designs circumvent the production limitations of conventional ribbed pipes. Above all in new power station developments with higher design values for the steam parameters the production of ribbed pipes is becoming ever more expensive as a result of the higher chrome content of the new materials needed for higher temperatures and pressures. Here the new swirl-generating fittings can replace the ribbed pipe or even make such applications possible for the first time.

BRIEF DESCRIPTION OF THE DRAWINGS

Different exemplary embodiments of the invention are explained in greater detail below with reference to a drawing. The figures show.

Parts which are the same have the same reference number in all figures.

DETAILED DESCRIPTION OF INVENTION

Figure 1:
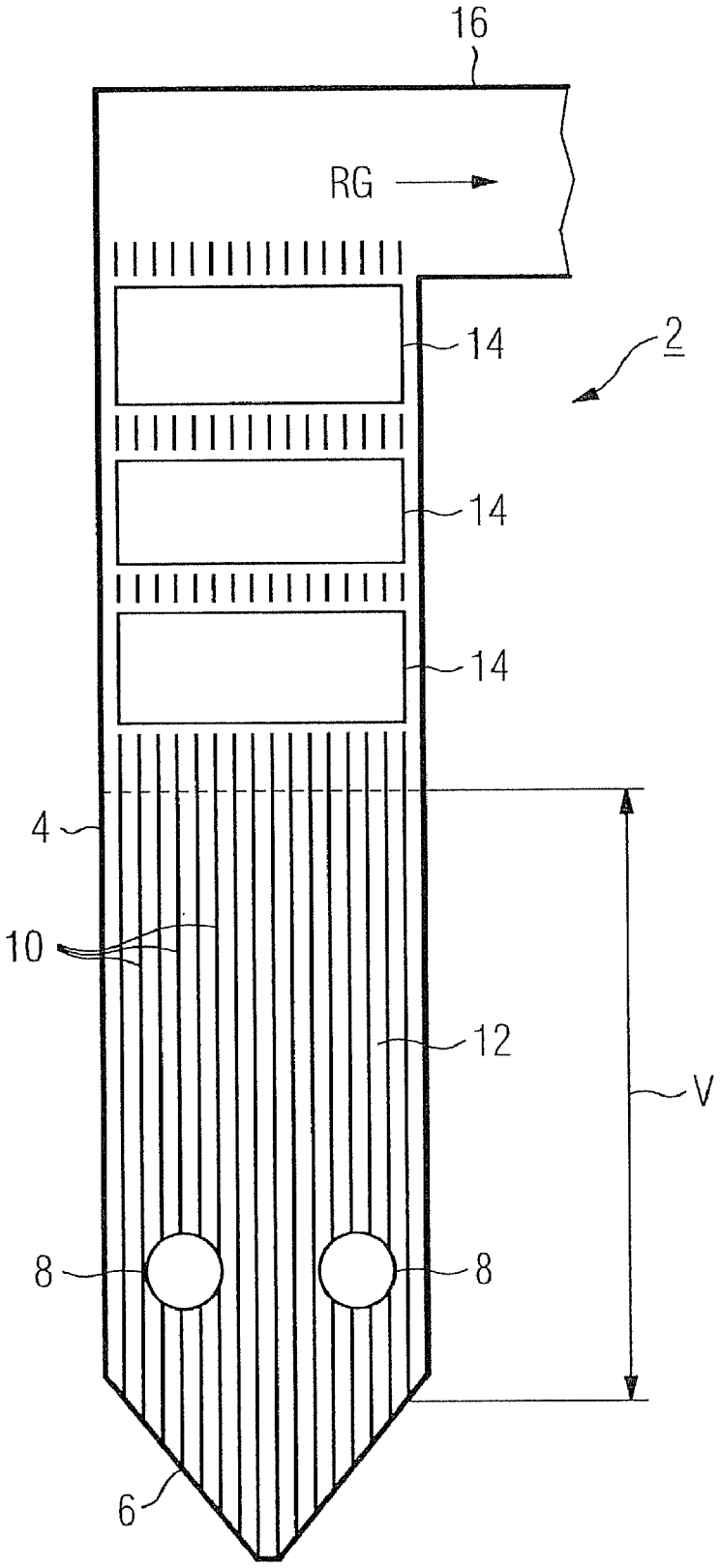
FIG. 1*a* continuous steam generator in a simplified diagram with a vertically-tubed combustion chamber wall, FIG. 2 a sectional view of a steam generator pipe with a insert embodying a swirl-generating inner profile, FIG. 3 a sectional view and a cross-section through a steam generator pipe in accordance with an alternate embodiment, and FIG. 4 a sectional view and a cross-section through a steam generator pipe in accordance with a further embodiment.

FIG. 1 shows a schematic diagram of a continuous steam generator 2 with a rectangular cross-section, of which the vertical gas draught is embodied by a surrounding wall- or combustion chamber wall 4 which transforms at its lower end into a funnel-shaped floor 6.

In a firing area V of the gas draught a number of burners for a fuel are each accommodated in an opening 8, of which only two are visible in the combustion chamber wall 4 made up of steam generator pipes 10. The vertically arranged steam generator pipes 10 are welded together in a gas-tight manner in the firing area V to form a continuous evaporating heating surface 12.

Above the firing area V of the gas draught are located convection heating surfaces 14. Above these is located a flue gas exit duct 16, via which the flue gas RG created by the combustion of a fossil fuel leaves the vertical gas draught. The flow medium flowing in the steam generator pipes 10 is heated up by the radiant heat of the burner flames and by convective heat transfer from flue gas RG and is thereby evaporated. Water or a water-steam mixture is provided as the flow medium in the exemplary embodiment.

As well as the single-draught vessel shown in FIG. 1 (so called tower vessel) further vessel configurations, e.g. in the form of a two-draught vessel, are also possible. The steam generator pipes to be described below can be employed with all these variants, and can be used both in the firing area and the remainder of the flue gas duct. Use in a heat recovery steam generator is also conceivable.

Figure 2:
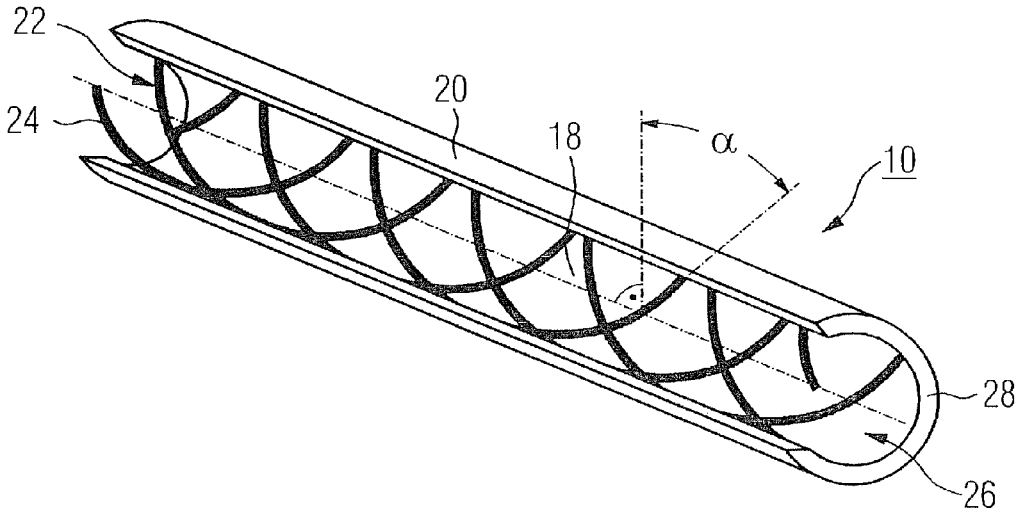

FIG. 2 shows in a cutaway view of a section of a steam generator pipe 10 used for piping of the combustion chamber wall 4 of the continuous steam generator 2. An insert 22 is introduced into the interior 18 of a smooth pipe 20, which is embodied to improve the heat transfer behavior of a swirl-generating inner profile. The insert 22 comprises in the exemplary embodiment three wires 24, which wind along the inner wall of the pipe 26 as a type three-start thread with constant angle of inclination $\alpha$ (and thus with constant start height). As a result of their internal tension the wires 24 lie thinly against the inner wall of the pipe 26. In addition the wires 24 are each fixed at a number of points, especially in the vicinity of their two ends, by spot welding to the wall of the pipe 26.

In the exemplary embodiment the wires 24, like the pipe wall 28 of the smooth pipe 20 accommodating them, consist of a highly heat-resistant metallic material with a high proportion of chrome. Other suitable materials exist as well of course, which are familiar to the person skilled in the art, e.g. 13CrMo44. As well as the number of wires 24 (number of starts of the spiral spring) and the angle of inclination $\alpha$, the cross-sectional profile of the wires 24 is an important design criterion. In particular because of the separate production of the respective wire 24 from the smooth pipe 20, its height and width as well as the edge angle in relation to the inner wall of the pipe 26 and the sharpness of the edges can be predetermined in any given way. In a first approximation the geometrical parameters are as a rule selected to be similar to those of the ribs of conventional ribbed pipes. In addition there can also be a location-dependent adaptation and optimization which takes into account the course of the heating profile along the combustion chamber wall 4.

Figure 3:
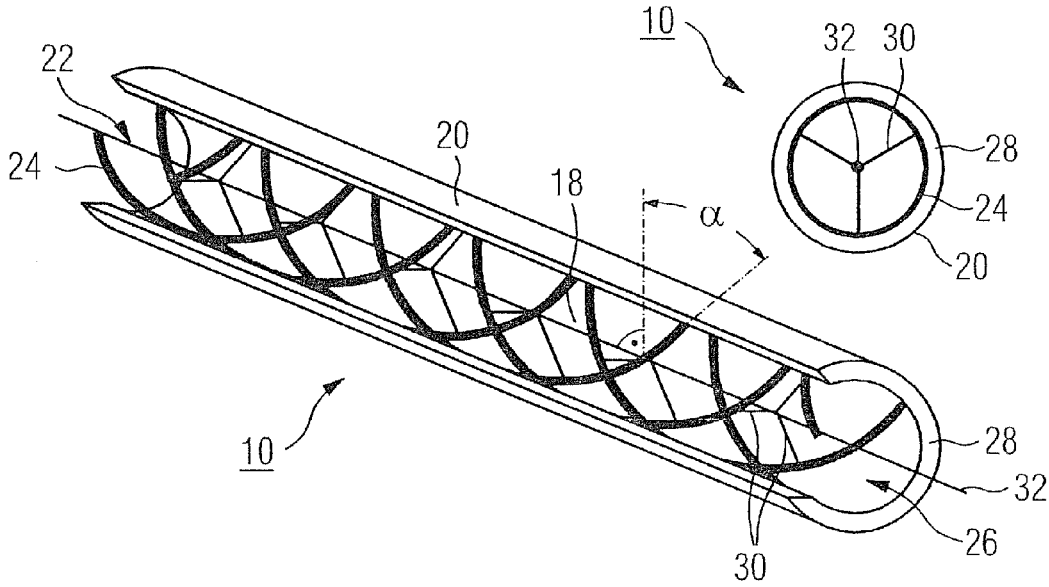

FIG. 3 shows a development of the known embodiment of the steam generator pipes 10 from FIG. 2, in which the wires 24 lying against the inner wall of the pipe 26 are connected via welded-on radial stiffening stays 30 to a center wire 32 running along the axis of the pipe, so that the shaking loose of the individual spring starts or wire windings in relation to each other is effectively prevented even if the spring effect weakens. Since here the support core comprising the stiffening stays 30 and the center wire 32 is not subjected to such high temperatures as the swirl-generating wires 24 present on the inner wall of the pipe 26, it is made of a less expensive material.

In the exemplary embodiment depicted in FIG. 3 three of the thin radial strengthening says 30 are combined into a regular star lying in a common sectional plane through the steam generator pipe 10. A number of these stars are arranged at regular intervals one after the other in the longitudinal direction of the steam generator pipe 10. As can be seen from the right-hand upper section of the cross-section through the steam generator pipe 10 shown in FIG. 3, all stars are aligned the same, so that the strengthening stays 30 corresponding to each other of stars arranged behind each other come to lie so that they coincide in cross section. This means that the swirl stream in the inside of the pipe 18 is only insignificantly disturbed.

Figure 4:
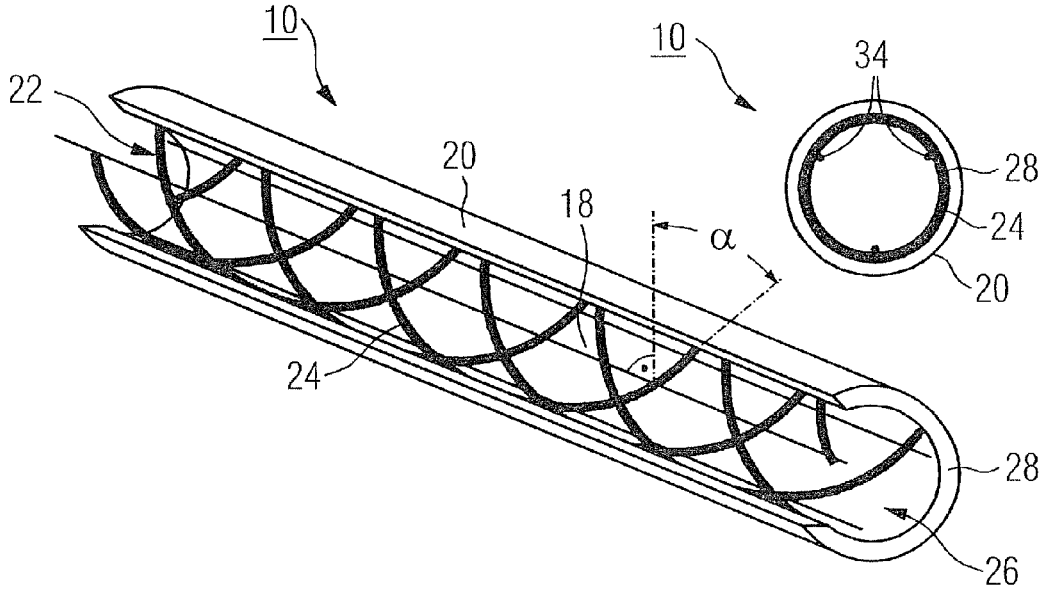

FIG. 4 finally shows a further variant of an embodiment which can also be combined with the variant known from FIG. 3. In this case three retaining wires 34 are provided in parallel to the pipe axis, which prevent the swirl-generating wires wound in the shape of a spiral 24 from shaking loose. The retaining wires 34, when viewed in cross section, are distributed evenly over the inner circumference of the pipe and are fixed in each case to the wires 24 forming the profile on the side of said wires facing towards the inside of the pipe 18.

The invention claimed is:

1. A steam generator pipe, comprising:

a pipe having an inner side; and an insert arranged in the inside of the pipe for forming a swirl-generating internal profile, where the insert comprises a plurality of wires which wind in a spiral shape as a type of multi-start thread along the inner wall of the pipe, wherein the wires lying against the inner wall of the pipe are connected to each other and to a center wire running along the axis of the pipe via radial strengthening stays.

2. The steam generator pipe as claimed in claim 1, wherein the angle of inclination of the respective wire is between 30° and 70° compared to a reference plane oriented at right angles to the pipe axis.

3. The steam generator pipe as claimed in claim 2, wherein the respective wire has a round cross section.

4. The steam generator pipe as claimed in claim 2, wherein the respective wire has an essentially rectangular cross section.

5. The steam generator pipe as claimed in claim 1, wherein the respective wire is seated at an intended operating temperature in a non-slip manner in the inside of the pipe as a result of internal tension of the wire.

6. The steam generator pipe as claimed in claim 1, further comprising a plurality of retaining wires running in the direction of the pipe axis, each fixed to the wires on the side of the wires facing toward the inside of the pipe.

7. The steam generator pipe as claimed in claim 1 wherein the respective wire is firmly connected at a point, preferably in the vicinity of its two ends, to the inner wall of the pipe.

8. The steam generator pipe as claimed in claim 7, wherein the film connection is a welded connection.

9. The steam generator pipe as claimed in claim 1, wherein at least the portion of the insert in contact with the inner wall of the pipe is produced from a material with a similar material composition to the pipe material.

10. The steam generator pipe as claimed in claim 1, further comprising a plurality of inserts arranged in separate pipe sections in each case, with the respective insert adapted with its geometrical parameters to the local heating provided during operation and/or to the local flow conditions.

11. A continuous steam generator, comprising:

a plurality of steam generator pipes, where each steam generator pipe comprises a pipe having an inner side, and an insert arranged in the inside of the pipe, where the insert comprises a plurality of wires which wind in a spiral shape as a type of multi-start thread along the inner wall of the pipe, wherein the plurality of wires lying against the inner wall of the pipe are connected to each other and to a center wire running along an axis of the pipe via radial strengthening stays.

12. The steam generator as claimed in claim 11, wherein the angle of inclination of each of the wires is between 30° and 70° compared to a reference plane oriented at right angles to the pipe axis.

* * * * *

UNITED STATES PATENT AND TRADEMARK OFFICE

CERTIFICATE OF CORRECTION

PATENT NO. : 8,122,856 B2
APPLICATION NO. : 12/086100
DATED : February 28, 2012
INVENTOR(S) : Joachim Franke, Oliver Herbst and Holger Schmidt It is certified that error appears in the above-identified patent and that said Letters Patent is hereby corrected as shown below:

Col. 8, line 24, remove [film] and insert --firm--

Signed and Sealed this
Eighteenth Day of December, 2012

David J. Kappos

David J. Kappos
*Director of the United States Patent and Trademark Office*